United States Patent [19]

Hamlett

[11] Patent Number: 4,957,093

[45] Date of Patent: Sep. 18, 1990

[54] COMPOUND BOW HAVING A PISTOL GRIP

[76] Inventor: Bruce R. Hamlett, 6027, Armadore, Union Lake, Mich. 48085

[21] Appl. No.: 382,732

[22] Filed: Jul. 19, 1989

Related U.S. Application Data

[63] Continuation-in-part of Ser. No. 134,468, Dec. 17, 1987, abandoned.

[51] Int. Cl.[5] ..... F14B 5/00

[52] U.S. Cl. ..... 124/24.1; 124/87; 124/88; 124/89; 124/23.1; 124/25.6

[58] Field of Search ..... 124/23 R, 25, 89, 88, 124/DIG. 1, 20 A, 20 B, 24, 24 R, 16, 17, 20 R, 84, 87

[56] References Cited

U.S. PATENT DOCUMENTS

| | | | |
|---|---|---|---|
| 3,406,675 | 10/1968 | Fredrickson | 124/24 |
| 3,599,621 | 8/1971 | Scrobell | 124/23 R |
| 3,614,947 | 10/1971 | Feldman | 124/20 |
| 4,124,014 | 11/1978 | Darlington | 124/88 |
| 4,282,850 | 8/1981 | Warnicke | 124/24 R |
| 4,343,286 | 8/1982 | Thacker | 124/24 R |
| 4,457,287 | 7/1984 | Babington | 124/23 R |
| 4,587,945 | 5/1986 | Little | 124/87 |
| 4,603,676 | 8/1986 | Luoma | 124/25 |
| 4,662,344 | 5/1987 | Mitchell | 124/22 |
| 4,686,956 | 8/1987 | Troncoso, Jr. | 124/41 A |
| 4,787,361 | 11/1988 | Vyprachticky | 124/88 |

OTHER PUBLICATIONS

Advertisement, Darton Archery Company, 1989.

*Primary Examiner*—Dennis L. Taylor
*Assistant Examiner*—J. Russell McBee
*Attorney, Agent, or Firm*—Basile and Hanlon

[57] ABSTRACT

A compound bow including a rigid central body portion having an arrow window recess in one side and a pair of bow limbs fixedly mounted to the front of the body. The central body portion is pivotally mounted to a support assembly for limited floating pivotal movement of the general plane of the bow limbs, bowstring and arrow axis relative to the hand grip member. The hand grip member has a pistol grip and arm support, the grip being mountable at any of several positions along the fore and aft axis of the support assembly for adjustment of the draw length without the necessity of changing pulleys or arrow length. The pivotal float between the support assembly and the bow plane eliminates misaligning torques placed on the arrow allowing greatly increased accuracy. A modified version of the compound bow comprises a frame including a body portion and two tensionable, planar arms extending therefrom, at least two pulleys mounted on the frame, a grip asymmetrically mounted on the body portion and projecting from one side thereof and a forearm support mounted on the body portion which, when the grip is grasped by an archer, cooperates with the grip to help steady the body. When in use, the bow is held at a substantial angle with reference to the vertical.

28 Claims, 5 Drawing Sheets

COMPOUND BOW HAVING A PISTOL GRIP

REFERENCE TO RELATED APPLICATION

This application is a continuation-in-part of my copending application Ser. No. 07/134,468 filed on Dec. 17, 1987.

BACKGROUND OF THE INVENTION

Description of the Prior Art

The present invention relates to improvements to compound handbows, and is particularly directed to a grip, arrow and arrow rest arrangement which substantially reduces the overall size of the bow, eliminated inherent and subsequent torques which reduces accuracy and teaches a new method of shooting which improves the viewing of the target.

Compound bows employ a relatively complex cable and pulley arrangement in which the geometry of the system is quite critical. Due to the use of a system of multiple pulleys mounted on the bow, around and through which the bowstring is strung, maximum draw pressure is exerted only during the first half or two-thirds of its displacement. As the bowstring is drawn back toward its maximum deflection, a sudden drop in draw pressure is experienced and the archer may easily draw the bowstring back through its remaining draw distance. Thus, accuracy is greatly enhanced because the draw pressure exerted on the bowstring, when fully drawn back, is relatively small. By using the pulleys, not only is the draw pressure at full draw distance greatly reduced, by the length of the bow is also minimized since a relatively long bowstring may be used and wound around the pulleys in such a manner as to shorten the total length of the bow. However, a typical compound bow is still relatively long, and hence, relatively awkward to carry, especially through heavy underbrush conditions typically encountered during archery hunting.

Of particular concern in the design of compound bows is the relatively lengthy central body portion located between the inner ends of the tensionable limbs. This central body incorporates three essential elements, the sight window, arrow passage and the handle grip, in the longitudinal bow plane, thus accumulatively lengthening the overall dimension of the bow. More specifically, an offset upper portion is required to allow the arrow to lie in the longitudinal bow plane defined by the tensionable limbs, central body portion and bowstring and also to provide a sight window for the archer since, in the vertically upright position in which the bow is held, the body portion will normally block the archer's view. Additionally, at a position below the offset portion as described previously, the handle extends vertically at a position which is in line and parallel to the longitudinal axis of the bow. The placement of the handle in the central body portion of the bow disposed, as it is, below the offset portion and in a vertical orientation results in a substantial height of the central portion.

When designing a compound bow, it would be desirable to have the arrow, as it is drawn and shot, positioned in the bow plane as to bisect the bow's overall length, as defined by the distance between the bow string's anchoring points upon the outermost end of the tensionable limbs. Having the arrow in this bisecting position as the bow is fully drawn, the angles produced between the arrow and the string are equal on either side. Thus when released, forces produced by each tensionable limb are equally transferred to the arrow. It would also be desirable to have the cup portion of the hand grip, as defined by the radius formed in the grip to accept the cupped portion of the holding hand being at the base of the thumb and index finger, to be located in the bow plane and in the bisecting plane of the bow's overall length, as defined previously. When drawing the bow string, this position balances the tensionable limb force on the bow holding hand. Thus the bow can be drawn without any rotational tendencies about the bow holding hand.

An inline arrangement of the hand grip and arrow position cannot accomplish the desired location of both. This is due to the fact that the arrow would have to pass through the archer's bow holding hand. Thus a compromise with either or both positions is required, resulting in a design which has forces inherently imbalanced. This imbalance of force puts a torque on the archer's holding hand and/or creates a misaligned thrust on the arrow.

A second torque induced while shooting a typical compound bow is not inherent to the offset relation of the arrow axis to the grip, but, due to an archer's grasp on the handle. If an archer happens to grasp the bow, as to twist the handle, while in the fully drawn position at the time of release of the arrow, a misalignment occurs which angles the bowstring away from its normal plane of travel. When the archer releases the bowstring, thus launching the arrow, the misaligned string realigns during the stroke of the string resulting in a deflecting action to the arrow's flight. These problems will combine to greatly decrease the accuracy of the archer using a standard bow.

Given the fact that different archers have different physiques, some adaptation of the archer to the particular bow is normally required. The optimum full-draw position of the bow involves the gripping of the bow with one hand and the drawing back of the string with the other until the string touches the archer's cheekbone below his sighting eye. The arm holding the bow is thus extended to establish the draw length at the correct distance forwardly from the fixed reference point constituted by the archer's cheekbone. Where the grip is in a permanently fixed relationship to the bow limbs, as described above, archer's with different draw lengths are required to fit the bow with specific pulleys having either larger of smaller circumferences to accommodate the individual archer's draw.

The present invention is especially directed to an asymmetrical pistol grip assembly adapted for compound bow usage which includes an arrow positioning arrangement which accomodates positive positioning of the arrow at the center line of the bow plane and which removes the grip and sight window from the central portion of the body thereby greatly reducing the bow height and placing the grip at a position which eliminates misdirecting torques applied upon the arrow.

SUMMARY OF THE INVENTION

In accordance with the present invention, a pair of resilient bow limbs are each fixedly mounted at one end upon the front side of a rigid central body portion. The adjacent ends of the two limbs are spaced from each other on the central body, extending outwardly, and a conventional cable-bowstring arrangement is operatively trained about pulleys which are carried at the opposite ends of the respective limbs. A laterally offset portion formed at one side of the central body portion extends rearwardly across the body in the space between the limbs, providing only for the free passage of an arrow through the bow. A sight window portion is not used. In this manner, the arrow axis is maintained in the general plane of the bowstring and limbs and, additionally, the arrow bisects the bow plane formed by the central body portion, the outwardly extending limbs and the bowstring. At a rearward position on the central body portion, a pair of arms projects rearwardly at opposite sides of the laterally offset arrow window.

A support assembly is formed with a generally flat main portion having a pair of rearwardly inclined arms extending from the flat main portion in spaced parallel relationship with each other. The rearwardly inclined arms correspond to the arms projecting from the central body portion and are pivotally connected to the arms thereby enabling the central body portion, limbs, and bowstring to be pivoted relative to the support assembly about an axis which lies in the bow plane. In other words, the axis of the pivot lies in the bow plane formed by the central body portion, the outwardly extending flexible limbs, and the bowstring and, additionally, extends perpendicularly to the front to rear dimension of the arrow window. The generally flat main portion of the support assembly normally lies in face-to-face relationship with that side of the central body portion opposite to the side in which the laterally offset arrow window recess is formed. Inter-engaging stop members, formed between the arms of the central body portion and the support assembly accommodate limitations to the pivotal movemment of the central body portion and the support assembly relative to one another.

A piston type grip is mounted on the flat main portion of the support assembly to project outwardly from the side of the grip member remote from the central body portion. The handle grip extends outwardly along a central axis which perpendicularly bisects the longitudinal bow plane and intersects the center line, or arrow axis, of the laterally offset arrow passage of the main body portion. The flat main portion of the support assembly is provided with a series of grip mount openings spaced from each other in a front to rear orientation along the arrow axis. The openings allow the position of the grip, relative to the bow limbs and central body portion, to be selectively adjusted in a forward or rearward direction to accommodate an adjustment in the draw length of the individual archer without the normal requirement of pulley replacement.

A forearm support is mounted to the support assembly on the same side of the assembly as the handle grip. The forearm support extends rearwardly at an outwardly disposed angle from the flat main portion so as to be positioned to engage the forearm of the archer when the bow is held in a firing position. The forearm support, in cooperation with the handle grip, steadies the bow and acts to displace the forearm of the archer out of the path of the bowstring thereby eliminating the need for a forearm guard as used with many standard hand bows.

The specific arrangement of the components and elimination of the sight window is designed for a new method of shooting, in which the archer holds the bow so that the longitudinal bow plane is at an acute angle to the horizon. In this position the archer has full view of the target, eliminating the need for additional length in the offset portion of the bow's central body.

Because the design of the bow places each component in precise and balanced alignment with relation to the arrow axis and the bow plane, the bow is completely ambidextrous requiring only the removal and repositioning of the bow sight and rest to the symmetrically located mounting position on the opposite side of the arrow to accommodate left or right-handed usage. Additionally, the placement of the pivot axis in the bow plane eliminates any forces which would result, due to the placement of the pivot axis in an offset relationship to the bow plane, on the arrow when fired. As a result, any axial offset which would tend to create a misaligning torque on the bowstring when drawn and which, when released, would re-center the string causing a redirection of the arrow off target is eliminated by the present design. Any sideways force exerted on the bowstring by the archer during his draw is compensated for by the hinging action between the support assembly and the main body portion. The result is a greatly increased accuracy and a compound bow of greatly reduced size.

Other objects and features of the invention will become apparent by reference to the following specification and to the drawing.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

Figure 1:
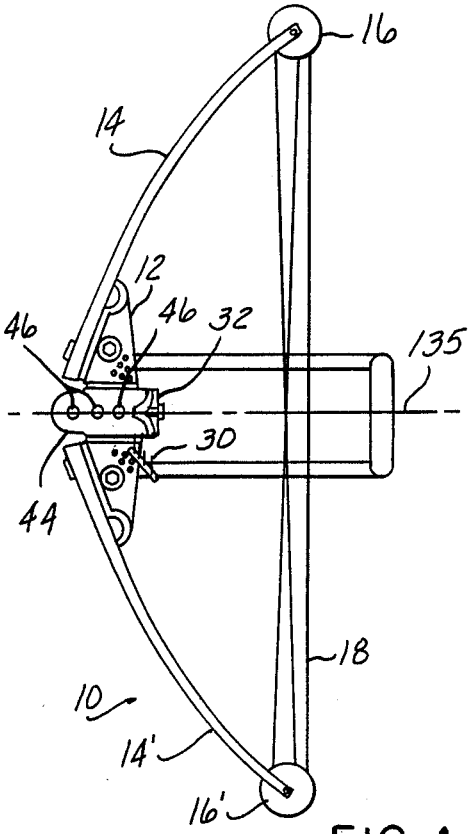
FIG. 1 is a plan view of one example of a compound bow constructed in accordance with the teachings of the instant invention.

Throughout the following detailed description, like reference numerals are used to reference the same feature of the invention shown in multiple figures.

Figure 2:
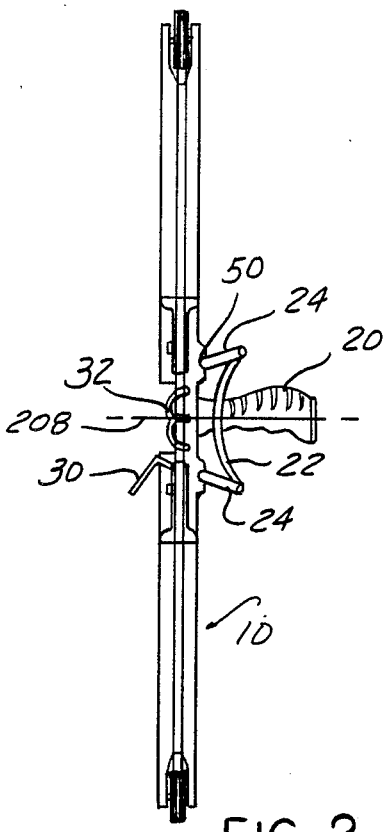
FIG. 2 is a rear view of the compound bow of FIG. 1.
Figure 3:
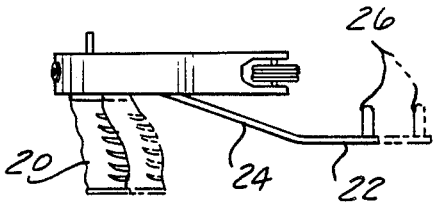
FIG. 3 is a side elevational view of the compound bow of FIG. 1 showing the grip and forearm support mounted on the opposite side.

Referring now to the drawings and, in particular, to FIGS. 1 and 2, there is depicted an improved compound bow 10 of the present invention comprising a frame 11 having a central body 12 and two tensionable limbs 14, 14' extending from said central body 12. At least two pulleys 16 and 16' are mounted on the second outer ends of each tensionable limb 14, 14'. It should be noted that the embodiments depicted herein illustrate a compound bow having only one pair of pulleys mounted on the frame. However, other types of bows may have additional pairs of pulleys. A grip 20 is asymmetrically mounted on the body portion 12 and projects from one side thereof. The manner in which the grip 20 projects from bow 10 may be seen in FIGS. 2 and 3, where the grip 20 projects from the right hand side of the bow 10. It is highly desirable that the grip 20 be formed as a conventional pistol grip projecting from the frame 11 at more or less 90° with respect thereto so that its axis 200 extends perpendicularly to a longitudinal bow plane 202 defined by the tensionable limbs, the central body and the bow string, as shown in FIG. 2. Additionally, the axis 200 of handle grip 20 intersects the arrow axis 135, see FIG. 7, which lies in the bow plane 202 just described. The relationship of the handle grip axis 200 to the bow plane and the arrow axis 135 provides a very well balanced and stable configuration greatly enhancing the accuracy of the bow. Additionally, the placement of the handle in this manner allows the central body 12 to be reduced in size. A bow string 18 is shown attached to bow 10. A manner of attachment and stringing of said bow strings 18 around said pulley 16, 16' is entirely conventional as depicted.

The compound bow 10 of the instant invention further comprises a forearm support 22. The forearm support 22 comprises a pair of angled members 24 which angularly and rearwardly project from apertures 50 in the central body of the angled members projecting outwardly from the same side of the central body as grip 20, see FIG. 3. Forearm support 22 further comprises a forearm receiving portion 26 which is designed to receive and engage the upper surface 28 of the archer's forearm forcing it away from said bowstring 18, thus eliminating the possibility of contact between the archer's forearm and bowstring 18 when the bow is shot.

A central body 12 of the instant invention may further comprise an offset portion 52 which, in cooperation with the end of tensionable limbs 14, 14', define a window 54. Window 54 is for the passage of the arrow, broadhead and fletching through the central body 12. Window 54 opening is in the opposite direction of the grip 20 as to allow the archer to look down the full length of the arrow when aiming at a target. Window 54 allows for top insertion of an arrow during loading, resulting in a loading method which is less prone to error. More specifically, the trough formed by the offset portion (52) is below the arrow and acts like a safety catch if the archer misloads the arrow. Rather than the arrow falling, obviously creating unwanted motion and noise, the arrow is simply replaced to its proper position.

Figure 4:
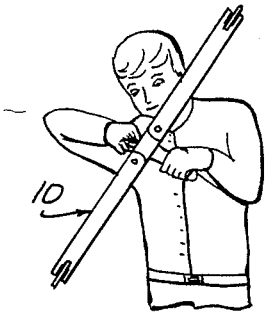
FIG. 4 is a front elevational view of the compound bows of FIGS. 3 and 9 while being held in operational position by an archer.
Figure 6:
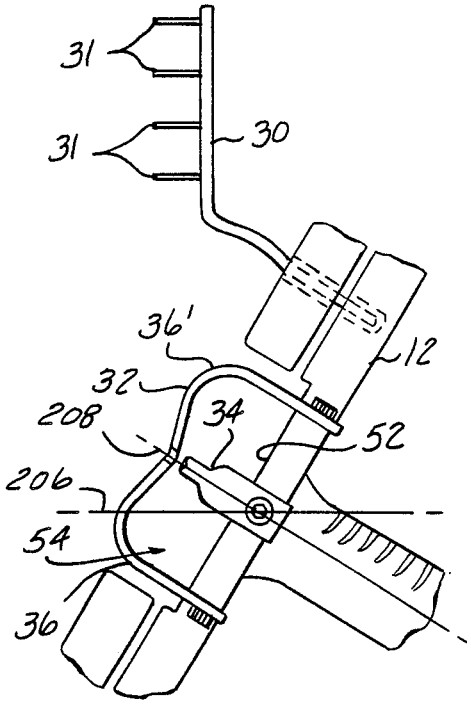
FIG. 6 is a detail view of the compound bow of FIG. 1 showing details of a sight.
Figure 7:
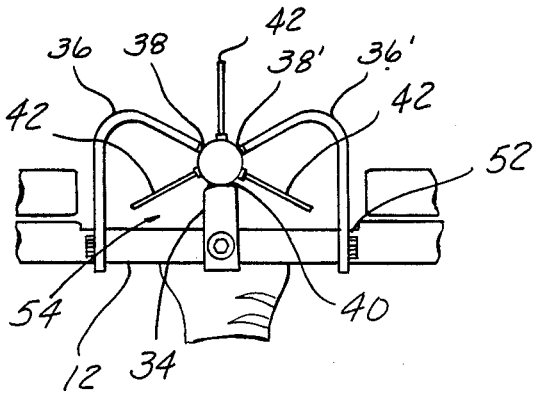
FIG. 7 is a detail view of the compound bow of FIG. 1 showing details of an arrow rest.

The offset portion 52 places the central body 12 between the grip 20 and the arrow as to protect the archer's holding hand from the arrow when shooting. This protection is required due to the desired drawing of the arrow tip behind the holding hand prior to release. Central body 12 has means for attaching a sight as shown in detail in FIG. 6. Sight 30 is angularly mounted on the frame 11 such that, when the bow is held in a position for shooting, as shown in FIG. 4, the sight 30 is substantially vertically plane 204 oriented to horizon 206, as indicated in FIG. 6. The bow is then simply sighted by lining the target up with one of a plurality of projections 31 which extend in a horizontal plane from sight 30. Additionally, window 54 may further comprise an improved arrow rest 32, shown in detail in FIGS. 6 and 7. The arrow rest 32 comprises a bottom rest point 34 and two contoured bends 36 and 36' which are mounted on central body 12. The ends 38 and 38' of contoured bends 36, 36' form two additional rest points when a conventional fletched arrow 40 is inserted therebetween. The fletching 42 of the arrow 40 will be disposed to pass between the rest points 34, 38, 38', as depicted in FIG. 7. In contrast to conventional arrow rests, the fletching of the arrow encounters no obstruction as the arrow is shot from the bow. Thus, the accuracy of the arrow is further improved.

In one embodiment of the instant invention, the grip 20 is adjustable with respect to its forward or rearward displacement on the central body 12. Means 44 of adjustably mounting the grip 20 are provided which comprise a plurality of spaced apertures formed in central body 12 which extend in parallel relationship to the arrow axis, as in FIG. 1. The plurality of spaced apertures 46 are designed to engage the grip 20. Thus, depending on which of the plurality of apertures 46 is selected, the position of the grip will be displaced either forwardly or rearwardly with respect to the bow 10. Thus, if, for example, the bow 10 has a 28" length between the string and the first aperture 46 nearest the string when fully drawn, then an archer with a 30" draw can simply move the grip 20 to the third aperture 46 to achieve his/her 30" draw. Additionally, it is a simple matter to provide the bow 10 with an ambidextrous grip mounted in one of the apertures 46 and the arrow rest and the sight 30 are then mounted 180° from either mounting location for right- or left-handed use. The left- or right-handed capability is not found in conventional bows which must be separately manufactured for right or left-handed archers.

Figure 5:
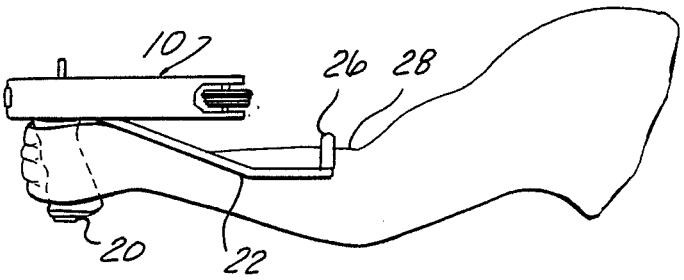
FIG. 5 is a side elevational view similar to FIG. 3 showing the relation of the arche's arm to the various components of the compound bow prior to rotation into the shooting position, as shown in FIG. 4.

Referring to FIGS. 1, 4, 5 and 6, a new method of shooting compound bow 10 requires the right-handed archer to grasp handle grip 20 with his/her left hand whereas the left forearm is then engaged with forearm receiving portion 26 as shown in FIG. 5. The archer using his right hand inserts an arrow by first nocking arrow to bowstring 18 and then placing an arrow onto arrow rest 32, thus supporting the arrow in the arrow axis 135 and bow bisecting plane 208 shown in FIG. 1. The archer then grasps the string with his/her right hand in a conventional manner and fully extends his/her left arm. The left arm is then rotated to an angle which disposes the handle grip 20 at an acute angle to the horizon 206, thus positioning the longitudinal bow plane 202 substantially perpendicular therefrom and aligning the sight 30 substantially vertical to the horizon 206. The bowstring 18 is then drawn to the archer's right check/jaw bone area, in a conventional manner, thus having the bowstring 18 cross in front of the archer's face diagonally as established by the bow holding position previously described. The archer using his/her sighting eye aligns the sight 30 with a target while the pivot 64 maintains alignment of the string 18 to the longitudinal bow plane 202 and releases the arrow, thus projecting the arrow towards the target. This preferred method of shooting using bow 10 allows the archer to see the target without obstruction of the bow 10 and also disposes the arrow such that the archer has full view of the arrow as it is drawn, released and projected towards the target. A left-handed archer would hold and/or shoot bow 10 in an opposite orientation as described.

Figure 8:
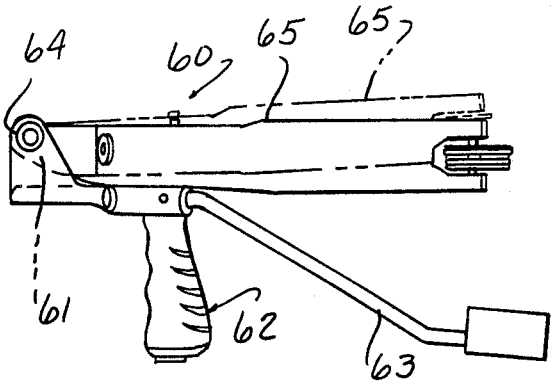
FIG. 8 is a top plan view of a second example of a bow constructed in accordance with the teachings of the instant invention.

In an alternative embodiment of the instant invention, a bow 60 is provided with a pivoting capability, as illustrated in FIG. 8. A support assembly 61 is provided to which is mounted a grip 62 and a forearm support 63 which cooperate in the manner described previously. The support assembly 61 is mounted on bow 60 by means of a pivot 64 which lies in the bow plane 202 described above and which intersects the arrow axis 135, as shown in FIG. 8. The pivot 64 provides the support assembly 61 wherein the grip 62 and forearm support 63 are mounted with the capability of pivoting relative to tensionable arm 65 and pulley 66 mounted thereon. The unpivoted condition of arm 65 and pulley 66 with respect to pivoting member 61 is shown in FIG. 8 in solid outline. As can be seen from that figure, if a bow string (not shown) were drawn straight back in the direction indicated by arrow A, it would be relatively easy to correctly and accurately sight the arrow, which would naturally fall in a straight line with the bow 60. However, if the bow string were drawn back at a slight angle, as illustrated by arrow B, it would be difficult to adjust a rigid bow to compensate for this angular deviation because of the bracing effect provided by the forearm support. In other words, if the direction of pull of the bow string is out of square with respect to the frame, the bow, the grip and the forearm support, the rigid bow provides no means of adjustment.

However, due to the fact that grip 62 and forearm support 63 are mounted on support assembly 61, the frame of bow 60 may be pivoted toward or away from these structures. As may be seen in phantom in FIG. 8, if the bow string is drawn back in the direction indicated by arrow B, tensionable arm 65 and pulley 66 will pivot away from grip 62 and forearm support 63, thus permitting the archer to accurately sight the arrow by squaring it up with respect to the arrow sight and accurately shoot the arrow in the direction desired.

Figure 9:
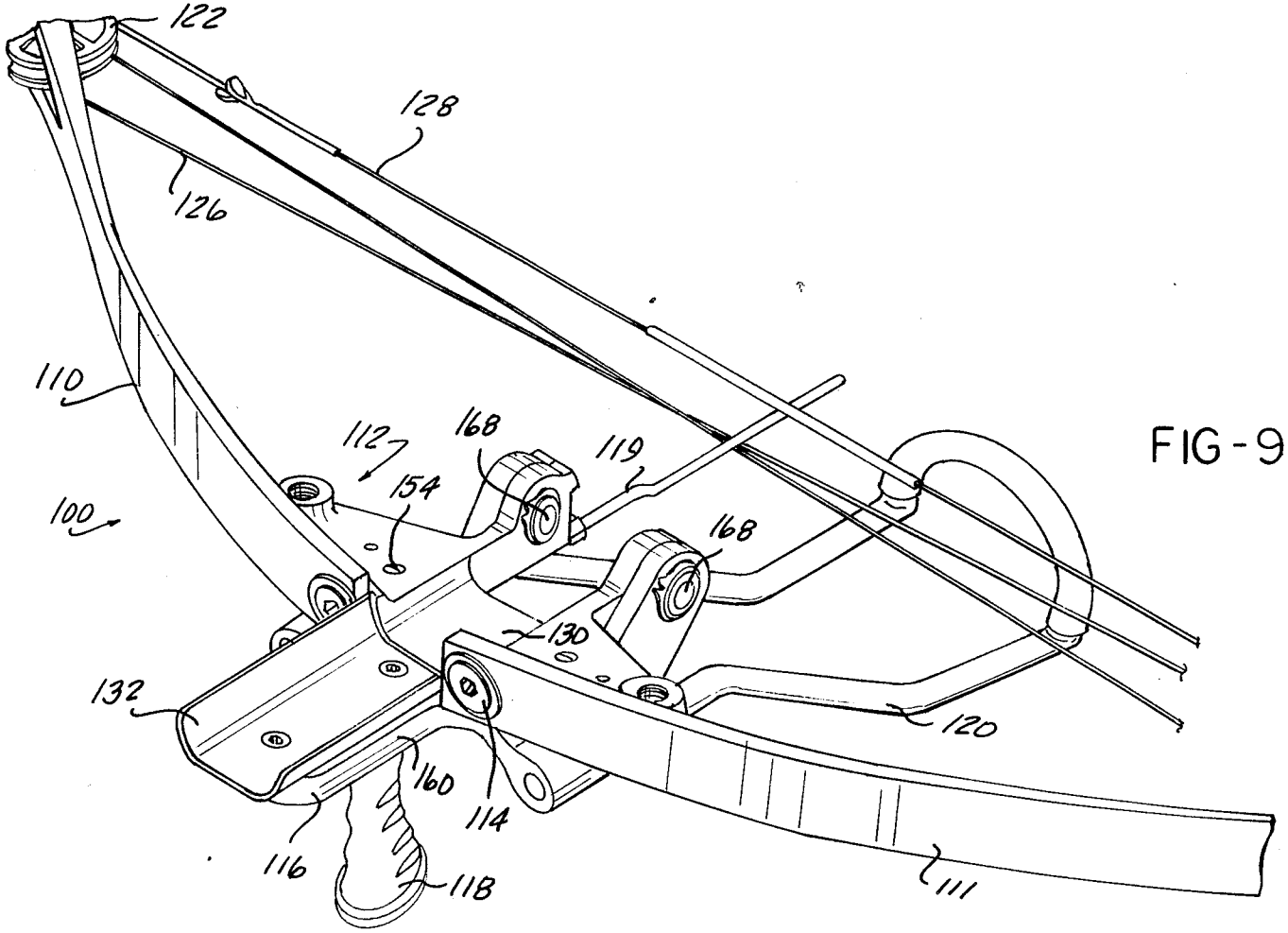
FIG. 9 is a perspective view of a third example of a compound bow embodying the present invention with certain parts broken away and the arrow rest and sight eliminated for clarity.

Referring now to FIG. 9, wherein a compound bow 100 embodying a third embodiment of the present invention, which incorporates all of the advantages and features described hereinbefore, is shown as comprising a pair of resilient bow limbs 110 and 111 fixedly mounted at their inner ends to a central body 112, utilizing suitable mounting fasteners 114, well known in the art. Central body 112 is, in turn, mounted through means to be described in more detail below, to a support assembly 116, to which is mounted, from a bottom portion thereof, a pistol type hand grip 118. Also fixedly mounted to support assembly 116 is a cable guide 119 and a forearm support 120. The forearm support 120 extends rearwardly at an outwardly disposed angle to engage the forearm of the archer.

The outer ends of limbs 110 and 111 mount pulleys 122 (only one of which is shown in FIG. 9) of conventional design and arrangement, about which a cable 126 and bowstring 128 are operatively trained, in a conventional manner well known in the art.

Figure 11:
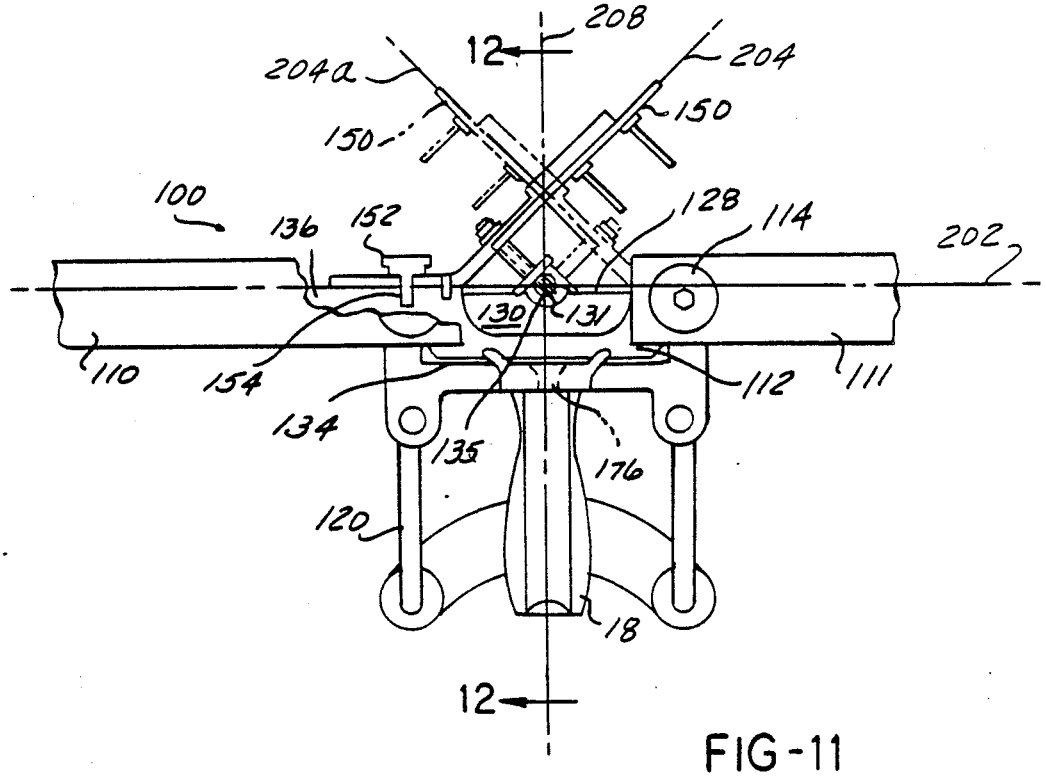
FIG. 11 is a partial front view of the compound bow of the present invention with certain parts broken away and the arrow and sight apparatus indicated for both left and right-handed use.

A laterally offset portion 130 which defines an arrow window is formed in one side of central body 112 between the adjacent or opposing inner ends of bow limbs 110 and 111 so that an arrow 131 (FIG. 11) nocked to bowstring 128 may be positioned relative to the bow 100 with the longitudinal axis 135 of the arrow 131 lying in the general plane 202 of the bow 100, defined by longitudinal central portions of bow limbs 110 and 111, and bowstring 128, as indicated in FIG. 11. The arrow 131 also lies in a plane 208 which bisects the bow plane 202. An arrow 131 lying in the bow plane 202 (as defined above) when fired will be free from misaligning torque which affects the accuracy of the arrow 131. The depth of offset portion 130 is such that upon release of arrow 131 from the drawn bow 100, the arrow 131, broadhead and its vanes pass freely through the arrow window defined by offset portion 130 of central body 112.

Offset portion 130 opens in a direction opposite to the hand grip 118 as to allow a top side arrow loading method which is less prone to error. More specifically, the trough formed by the offset portion 130 is below the arrow 131 and rest 150. The trough acts as a safety catch if the archer misloads the arrow 131 by allowing it to fall off the rest 150. The trough acting as a safety catch eliminates further motion of an arrow falling away from the bow which would alarm the archer's prey. Another benefit, in having the offset portion 130 open in the opposite direction of the hand grip 118, is to provide a full length view of the arrow 131 when aiming it at a target. Another purpose of arranging the offset portion 130 as it is, opening in the opposite direction of the hand grip 118, is to place the central body 112 and the main body portion 160 between the archer's hand grip 118 holding hand and the arrow 131. This arrangement acts to protect the archer's hand when an arrow 131 and its broadhead are drawn to the desired position behind the hand grip 118 and then released. A generally U-shaped trough 132 may be mounted upon or integrally formed into support assembly 116 thereby forming a continuation of offset portion 130 to further guard the archer's hand from the arrow 131.

FIG. 11 thus clearly illustrates the symmetry about the arrow axis 135 with respect to the tensionable limbs 110 and 111, the hand grip 118, the arm support 120 and the right- and left-hand mounting positions 204 and **204*a* of the sight and arrow rest assembly 150. This symmetry creates benefits which could not be possible if the arrow axis 131, hand grip 118, sight and rest assembly 150, forearm support 120 and the laterally offset portion 130** were arranged in any other position than that which is described.

Figure 10:
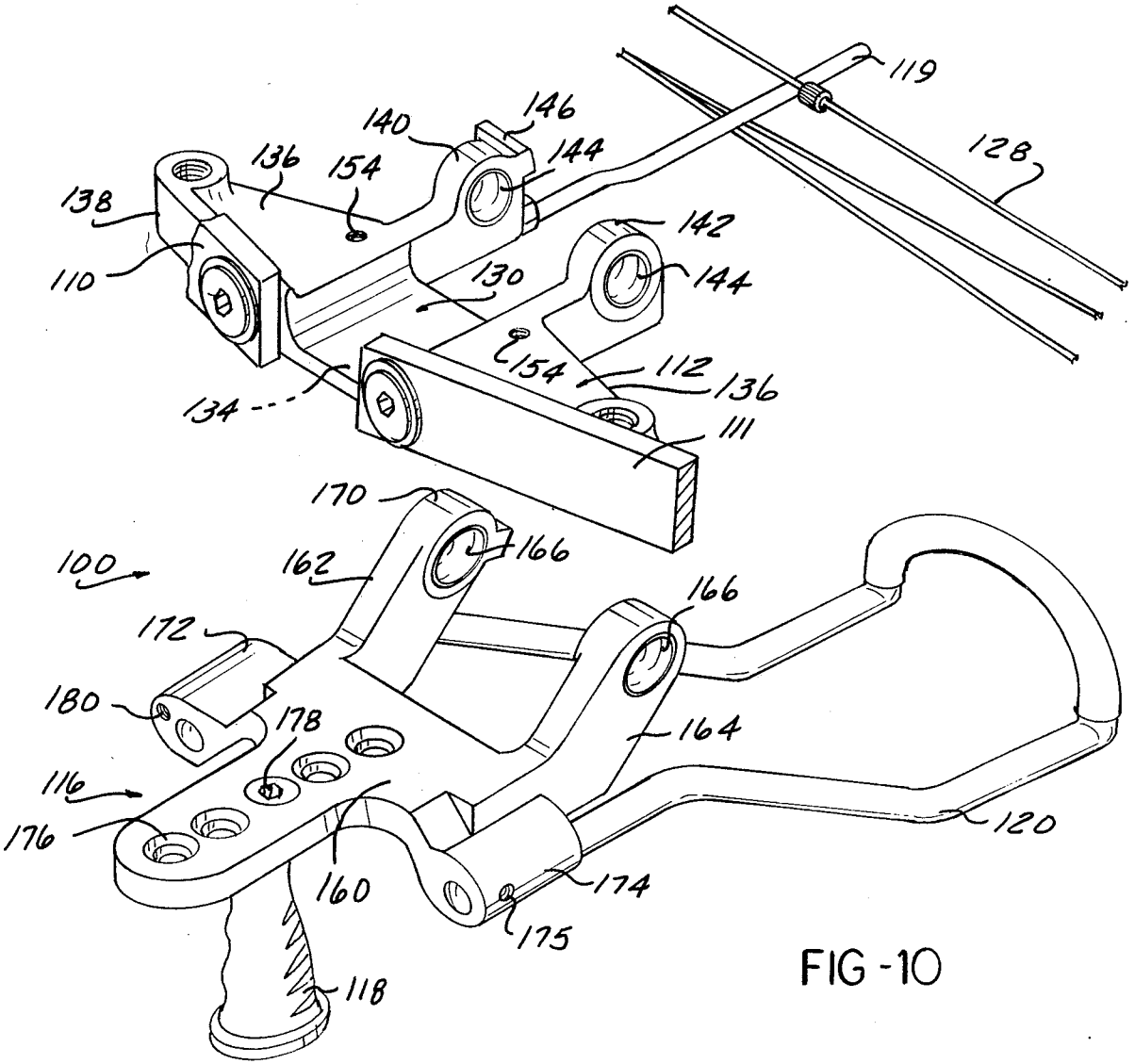
FIG. 10 is an exploded perspective view of the bow of FIG. 1 with certain parts broken away.

Referring now to FIG. 10, central body 112 is a rigid one-piece member having a flat side surface 134 (lower surface as viewed in FIG. 11) with a pair of outwardly projecting, triangular-shaped projections 136 which extend outwardly from opposite sides of offset portion 130. The forward surfaces of central body 112 (a portion of this forward surface being indicated at 138 in FIG. 10) are suitably curved to bear against the rearward surfaces of limbs 110 and 111 in face-to-face relationship therewith. A pair of arm portions 140 and 142 project rearwardly from central body 112 at opposite sides of recess 130 and are formed with aligned bearing bores 144. A stop member 146 is formed on one of the arms 140, 142 and projects laterally beyond the outer side surface of the arm. Bores 154 formed in projections 136, at opposite sides of offset portion 130, serve to mount elements of sight/arrow rest assembly 150, shown in FIG. 11. Mounting bores 154 are symmetrically placed on either side of offset portion 130, to allow for positioning of the sight/arrow rest assembly 150 on either side of offset portion 130 thereby allowing for ambidextrous use of the bow 100. A cable guard 119 may be positioned to extend from one of the arms 140, 142 to pass between the bowstring 128 and cable 126 in a well known manner.

Figure 12:
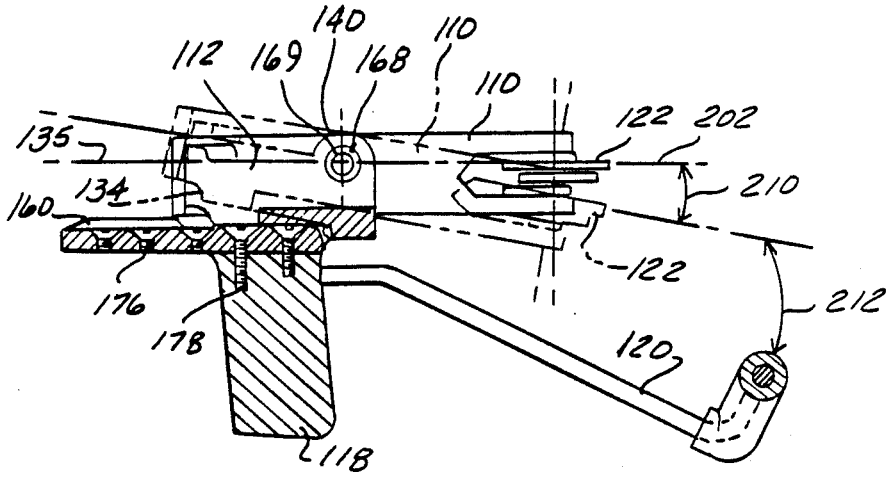
FIG. 12 is a fragmentary sectional view taken along line A—A of FIG. 11 showing the bow of the present invention with the arrow rest and sight eliminated for clarity.

Still referring to FIG. 10, it can be seen that support assembly 116 is formed with a flat platform-like main body portion 160. A pair of integral inclined arms 162 and 164 project rearwardly from platform 160 in spaced parallel relationship to each other. Arms 162 and 164 are formed with aligned bearing bores 166 at their outer ends and the spacing between arms 162 and 164 is such that the arms may be slidingly engaged with the respective outer side surfaces of arms 140 and 142 of central body 112 with bores 166 axially aligned with bores 144 to receive pivot assemblies 168, shown in FIG. 9. The pivot assembly 168 pivotally couples support assembly 116 to central body 112 for pivotal movement about pivot axes 169 (FIG. 12). Pivotal movement of support assembly 116 towards central body 112, as viewed in FIG. 9, is limited by the engagement of the main platform portion 160 of support assembly 116 with the flat under surface 134 of central body 112. Pivotal movement of support assembly 116 in the opposite direction is limited to arc 210 by the engagement of a stop projection 170, shown in FIG. 10, with projecting portion 146 on arm 140 of central body 112 leaving minimum string to arm clearance arc 212.

The axis of pivotal movement between central body 112 and support assembly 116 lies in the general bow plane 202 of limbs 110 and 111 and bowstring 128 and perpendicularly intersects the arrow axis 135 passing through offset portion 130.

A pair of bosses 172 and 174 are formed at opposite sides of platform-like main body portion 160 of support assembly 116 to receive the forward ends of forearm support 120. The forearm support 120 is fixedly secured into bosses 172, 174 by suitable means, such as threaded fastener 175 (FIG. 10). Additionally, a series of counter bores 176 are formed through platform-like main body portion 160 of support assembly 116 in spaced axial relationship to each other along the fore and aft center line of support assembly 116 defined by the arrow axis 135, shown in FIGS. 10, 11 and 12. Hand grip 118 may be fixedly mounted on support assembly 116 at a selected counter bore 176 by means of a fastening element 178 received in the counter bore 176 and threadably locked into hand grip 118. By selecting the appropriate counter bore 176, the draw length of the bow 100 may be varied to match the arm length of the archer without the need for changing the cam pulleys 122 or the arrow length. Thus when the bow is fully drawn, if the measurement between the first counterbore (176) nearest the string and the string is 28" and a certain archer requires 30" due to his/her arm length, then the hand grip 118 may be moved to the third counterbore 176, thus achieving a 30" draw. Forearm support 120 is so located, relative to hand grip 118, as to rest against the forearm of the archer when the archer grips hand grip 118 thereby providing additional stability to the bow 100 during shooting and forcing the forearm of the archer out of the area of travel of the bowstring 128 (FIG. 12). The action of the forearm support 120 in forcing the forearm out of the line of travel of the bowstring 128 negates the need for an arm guard in use on compound bows.

Bosses 172, 174 may be provided with tapped bores, such as at 180, to accommodate the mounting of auxiliary devices upon the support assembly 116.

As shown in FIG. 11, sight 150, shown in solid line for use by a right-handed archer, and in phantom for use by a left-handed archer, is fixedly attached to triangular-shaped projections 136 of central body 112 utilizing fixing means such as threaded bolt 152 engaged with bore 154. To change the bow from right-handed to left-handed use, the archer simply removes bolt 152 and places sight 150 on the opposite side of laterally offset portion 130 and reattaches sight/arrow rest assembly 150 using bolt 152 in corresponding bore 154. The sight-/arrow rest assembly 150 for arrow 131 is standard, and well known in the art, and will not be described further.

The pivotal interconnection between support assembly 116 and central body 112 accommodates a limited range of floating pivotal adjustment of the bow plane 202 containing the bow limbs 110 and 111, bowstring 128 and arrow axis 135 when the bow 100 is at full draw, as shown in FIG. 12. When the string 128 is drawn, a force is generated in the longitudinal bow plane 202 and an axial load is transmitted to the hand grip 118 due to the offset nature of the grip with relation to the longitudinal bow plane 202. The forearm support 120 prevents the bow 100 from rotating due to this axial load. However, the forces created by the axial load would make it possible to deflect the bowstring 128 off center when drawn to its full extension if the connection between the support assembly 116 and central body 112 were rigid. This deflection would act as a misdirecting force on the arrow 131 when the string 128 is released by the archer. This misdirection occurs when the string 128, being held in a deflected nature, is released, thus realigning during the returning stroke. The free floating pivot adjustment allows the bow 100 assembly to maintain precise alignment of the arrow 131 within the bow plane 202 when the string is drawn and released, thus eliminating forces tending to misdirect the arrow 131. As a result, at the time of bowstring release, only a forward driving force in the bow plane 202 is exerted upon the arrow 131. The placement of the hinge axis 169 in the bow plane 202 eliminates any forces which would result, due to the placement of the hinge axis in an offset relationship to the bow plane. Any axial offset from the bow plane 202 would create inherent misaligning torque on the bowstring 128 when drawn. Thus, having the pivotal axis located, as described above, eliminates both inherent and induced misaligning torque.

While certain embodiments of the invention have been described in detail above in relation to a compound bow having a pistol grip, it will be apparent to those skilled in the art that the disclosed embodiment may be modified. Therefore, the foregoing description is to be considered exemplary rather than limiting, and the true scope of the invention is that defined in the following claims.

What is claimed is:

1. A bow comprising a rigid central body portion, a pair of elongate resilient bow limbs each fixedly secured at one end to the front of said central body portion to project outwardly from opposite ends of said body, bow string means tensioned between the opposite ends of said limbs in rearwardly spaced relationship to said body, said limbs and bowstring means lying in a first longitudinal bow plane, the adjacent ends of said limbs being fixed to said body in spaced relationship to each other and said body having a laterally offset portion in one side thereof extending from front to rear across said body and defining an arrow window opening through the space between said one ends of said limbs accommodating the insertion during loading and free passage of an arrow when drawn and fired through said window with the longitudinal axis of said arrow maintained within said first longitudinal bow plane, first and second hinge means having a common longitudinal pivot axis lying in said longitudinal bow plane, such that said longitudinal pivot axis is disposed perpendicular to said longitudinal axis of said arrow, said first hinge means disposed between said arrow window opening and one of said ends of said central body, said second hinge means disposed between said arrow window opening and the other of said ends of said central body, a rigid support assembly including a main portion and a pistol type hand grip projecting from one side of said main portion, said main portion of said rigid support assembly connected to said rigid central body portion through said first and second hinge means for limited pivotal movement relative to said longitudinal bow plane to eliminate directional forces incident on said arrow, said pistol type hand grip disposed opposite to said offset arrow window opening and having a central axis intersecting said arrow axis, and an arm support fixedly mounted on said main portion in rearwardly spaced relationship to said hand grip.

2. The invention defined in claim 1 wherein said central body portion includes a pair of arms projecting rearwardly from said body at opposite ends of said window, said support assembly includes a pair of arms projecting rearwardly from said main portion, and means pivotally coupling the arms on said body respectively to the arms on said hand grip for pivotal movement about said pivot axis.

3. The invention defined in claim 2 wherein said pivot axis lies in said longitudinal bow plane and perpendicularly intersects said arrow axis.

4. The invention defined in claim 2 further comprising stop means engageable between said central body portion and said support assembly to limit pivotal movement of said central body relative to said support assembly.

5. The invention defined in claim 1 further comprising means for fixedly and detachably mounting said hand grip on said main portion of said support assembly at any of a plurality of positions along said arrow axis, between the front and rear ends of said main portion.

6. The invention defined in claim 1 wherein said laterally offset portion has a height in the longitudinal axis of the bow substantially the same as that required for arrow passage.

7. The invention defined in claim 1 wherein said laterally offset portion is offset from the bow plane in the same direction as said hand grip.

8. The invention defined in claim 1 wherein said forearm support extends outwardly at such an angle as to force the archer's forearm away from the travel of said bowstring.

9. The invention defined in claim 1 further comprising a sight and rest assembly mountable on either side of said laterally offset portion to accommodate right or left-handed archers.

10. A compound bow as defined in claim 1 wherein said hand grip, forearm support and laterally offset portion are symmetrical about a plane which perpendicularly bisects the longitudinal length of the bow.

11. A compound bow as defined in claim 1 wherein said arrow axis is substantially established by the intersection of said longitudinal bow plane with a plane perpendicularly bisecting the longitudinal length of said bow wherein said central axis of said hand grip lies in said plane.

12. A compound bow for projecting an arrow including:

a first and a second tensionable limb, each limb having first and second end portions;

a central body having first and second end portions adapted to support corresponding first end portions of said first and second tensionable limbs in an outwardly extending relationship thereto;

a pair of pulleys, one of said pulleys rotatably mounted on said second end portion of each tensionable limb with a bow string extending between said pulleys in a conventional manner;

said first and second tensionable limbs, said central body, and said bow string defining a longitudinal bow plane therebetween, wherein the improvement comprises:

a laterally offset portion formed in said central body defining an arrow passage such that an arrow is supportable with a longitudinal axis of the arrow disposed in said longitudinal bow plane;

said central body having first and second bearing bores with a coaxial longitudinal axis lying in said longitudinal bow plane such that said coaxial longitudinal axis is disposed perpendicular to said longitudinal axis of said arrow, said first bearing bore disposed between said arrow passage and said first end portion of said central body, said second bearing bore disposed between said arrow passage and said second end portion of said central body;

a support assembly pivotally mounted through the first and second bearing bores to said central body about said coaxial longitudinal axis lying in said longitudinal bow plane intersecting said arrow axis in a perpendicular relationship thereto, said assembly having a handle grip extending outwardly from said assembly opposite to said arrow passage with a central axis perpendicular to said longitudinal bow plane and intersecting said arrow axis; and a forearm support, mounted to said support assembly extending rearwardly at an outwardly disposed angle therefrom to engage the forearm of the archer in cooperation with said handle grip to steady said bow.

13. A compound bow, as defined in claim 12, said laterally offset portion having a height, in the longitudinal axis of said bow, substantially the same as that required for arrow passage.

14. A compound bow, as defined in claim 13, wherein said first end portions of said tensionable limbs are mounted to said central body in a position adjcent to said laterally offset portion.

15. The invention defined in claim 12 wherein said laterally offset portion is offset from the bow plane in the same direction as said hand grip.

16. A compound bow, as defined in claim 12, further comprising:

a series of spaced apertures formed in said support assembly extending parallel to said arrow axis, said handle grip selectably mountable in said apertures through attaching means to allow fore and aft adjustment of said handle grip.

17. A compound bow, as defined in claim 12, said forearm support further comprising:

a pair of members having first end portions which engage apertures formed in said support assembly and second ends extending rearwardly at an outwardly disposed angle therefrom; and a forearm receiving portion, adapted to extend between said second ends, for engagement with the upper forearm of the archer.

18. A compound bow, as defined in claim 17, wherein said forearm support extends outwardly at such an angle as to force the archer's forearm away from the travel of said bowstring.

19. A compound bow as defined in claim 12 wherein said arrow axis is substantially established by the intersection of said longitudinal bow plane with a plane perpendicularly bisecting the longitudinal length of said bow wherein said central axis of said hand grip lies in said plane.

20. A compound bow for projecting an arrow including:

a first and a second tensionable limb each having first and second end portions;

a central body having first and second end portions adapted to support corresponding first end portions of said first and second tensionable limbs in an outwardly extending relationship thereto;

a pair of pulleys, one of said pulleys rotatably mounted on said second end portion of each tensionable limb with a bowstring extending between said pulleys in a conventional manner;

said first and second tensionable limbs, said central body portion, and said bowstring defining a longitudinal bow plane therebetween, wherein the improvement comprises:

a laterally offset portion formed in said central body defining an arrow passage such that an arrow is supportable with a longitudinal axis of the arrow disposed in said longitudinal bow plane and centered between said limbs;

first and second arms extending from said central body with said arrow passage interposed between said first and second arms, each arm having a bearing bore formed therein defining a coaxial longitudinal hinge axis lying in said longitudinal bow plane and intersecting said arrow axis in a perpendicular relationship thereto;

a support assembly pivotally mounted through said bearing bores to said central body about said coaxial longitudinal hinge axis lying in said longitudinal bow plane and intersecting said arrow axis in a perpendicular relationship thereto, said support assembly including a handle grip mounted to said support assembly extending outwardly therefrom opposite said arrow passage with a central axis perpendicular to said longitudinal bow plane and intersecting said arrow axis; and a forearm support, mounted to said support assembly, extending rearwardly at an outwardly disposed angle therefrom to engage a forearm of an archer cooperating with said handle grip to steady the bow.

21. A compound bow, as defined in claim 20, said laterally offset portion having a height, in the longitudinal axis of said bow, substantially the same as that required for arrow passage.

22. A compound bow, as defined in claim 21, wherein said first end portions of said tensionable limbs are mounted to said central body in a position adjacent to said laterally offset portion.

23. The invention defined in claim 20 wherein said laterally offset portion is offset from the bow plane in the same direction as said hand grip.

24. A compound bow, as defined in claim 20, further comprising:

a series of spaced apertures formed in said support assembly extending parallel to said arrow axis, said handle grip selectably mountable in said apertures through attaching means to allow fore and aft adjustment of said handle grip along said arrow axis.

25. A compound bow, as defined in claim 20, said forearm support comprising:

a pair of members having first end portions which engage apertures formed in said central body and second ends extending rearwardly at an outwardly disposed angle therefrom; and a forearm receiving portion, adapted to extend between said second ends, for engagement with the upper forearm of the archer.

26. A compound bow, as defined in claim 25 wherein said forearm support extends outwardly at such an angle as to force the archer's forearm away from the line of travel of said bowstring.

27. In a compound bow for projecting an arrow including first and second tensionable limbs, each limb having first and second end portions, a central body having first and second end portions adapted to support corresponding first end portions of said first and second tensionable limbs in an outwadly extending relationship thereto, a pair of pulleys, one pulley rotatably mounted on said second end portion of each tensionable limb with a bow string extending between said pulleys in a conventional manner, said first and second tensionable limbs, said central body, and said bow string defining a longitudinal bow plane, a laterally offset portion formed in said central body defining an arrow passage for supporting an arrow having a longitudinal arrow axis disposed in said longitudinal bow plane;

the improvement comprising:

first and second arm portions extending from said central body with said arrow passage interposed between said first and second arm portions, each arm portion having a bearing bore formed therein defining a common longitudinal hinge axis lying in said longitudinal bow plane and intersecting said arrow axis in a perpendicular relationship thereto;

a stop member formed on one of said arm portions projecting laterally beyond an outer surface of said one of said arm portions;

a support member having first and second integral inclined arms formed thereon, each inclined arm having a bearing bore formed therein alignable in coaxial relationship with said bearing bores of said arm portions of said central body;

a stop projection formed on one of said inclined arms engageable with said stop member for limiting pivotal movement of said support member with respect to said central body;

first and second pivot members for pivotally coupling said support member to said central body such that said arrow passage is unobstructed, said first pivot member coupling said first arm portion to said first inclined arm through said aligned bearing bores, said second pivot member coupling said second arm portion to said second inclined arm through said aligned bearing bores; and a hand grip member connectable to said support member and having a central longitudinal axis generally normal to said longitudinal bow plane and intersecting said arrow axis in a generally perpendicular relationship thereto.

28. A compound bow as defined in claim 12 wherein said handle grip, forearm support and laterally offset portion are symmetrical about a plane which perpendicularly bisects the longitudinal length of the bow.

* * * * *